US011491532B2

(12) United States Patent
Deiss

(10) Patent No.: US 11,491,532 B2
(45) Date of Patent: Nov. 8, 2022

(54) DEVICE AND METHOD FOR REMOVING A WORKPIECE PART FROM THE REST OF THE WORKPIECE

(71) Applicant: TRUMPF Werkzeugmaschinen GmbH + Co. KG, Ditzingen (DE)

(72) Inventor: Magnus Deiss, Stuttgart (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 556 days.

(21) Appl. No.: 16/585,004

(22) Filed: Sep. 27, 2019

(65) Prior Publication Data

US 2020/0016647 A1 Jan. 16, 2020

Related U.S. Application Data

(63) Continuation of application No. PCT/EP2018/056884, filed on Mar. 19, 2018.

(30) Foreign Application Priority Data

Mar. 27, 2017 (DE) ..... 102017205095.0

(51) Int. Cl.
*B21D 43/00* (2006.01)
*B21D 43/28* (2006.01)
*B21D 28/06* (2006.01)

(52) U.S. Cl.
CPC ..... *B21D 43/287* (2013.01); *B21D 28/06* (2013.01)

(58) Field of Classification Search
CPC ..... B21D 43/287; B21D 28/06
See application file for complete search history.

(56) References Cited

U.S. PATENT DOCUMENTS 6,006,638 A * 12/1999 Eltringham ..... B21D 43/20 83/402
6,024,393 A 2/2000 Shamlou et al.
(Continued)

FOREIGN PATENT DOCUMENTS

CN 102773327 11/2012
CN 106391881 2/2017
(Continued)

OTHER PUBLICATIONS

CN Office Action in Chinese Appln. No. 201880022115.7, dated Jul. 10, 2020, 11 pages (with English translation).
(Continued)

*Primary Examiner* — Omar Flores Sanchez
(74) *Attorney, Agent, or Firm* — Fish & Richardson P.C.

(57) ABSTRACT

Methods and devices for removing a workpiece part from a remaining workpiece, comprise a holding apparatus that is moveable in a removal direction and switchable between a fixing state for fixing the workpiece part to the holding apparatus and a release state for releasing the workpiece part from the holding apparatus. The holding apparatus has at least one electrically conductive first contact element for contacting the workpiece part at one or more first contact points and at least one electrically conductive second contact element for contacting the workpiece part at one or more second contact points. The device also has a sensor apparatus that uses the contact elements to check, in a first check state, the complete separation of the workpiece part from the remaining workpiece and to check, in a second check state, fixing of the workpiece part to the holding apparatus being in the fixing state.

13 Claims, 3 Drawing Sheets

(56) References Cited

U.S. PATENT DOCUMENTS

| | | | | |
|---|---|---|---|---|
| 6,796,353 | B2 | 9/2004 | Lang et al. | |
| 7,405,577 | B2 | 7/2008 | Limper et al. | |
| 9,452,544 | B2 | 9/2016 | Hagenlocher et al. | |
| 10,953,456 | B2 * | 3/2021 | Kitamoto | B21D 37/205 |
| 2016/0368040 | A1 | 12/2016 | Traenklein et al. | |
| 2017/0066033 | A1 | 3/2017 | Prokop et al. | |
| 2019/0388950 | A1 * | 12/2019 | Li | B21D 43/287 |

FOREIGN PATENT DOCUMENTS

| | | | |
|---|---|---|---|
| CN | 106391904 | 2/2017 | |
| DE | 10144048 | 3/2003 | G02B 21/34 |
| DE | 10259190 | 5/2004 | G01N 27/04 |
| DE | 102011004117 | 8/2012 | B23K 26/03 |
| DE | 202010017944 | 5/2013 | B23K 26/03 |
| DE | 102014209811 | 11/2015 | B21D 45/00 |
| DE | 202014010730 | 7/2016 | B21D 45/00 |
| DE | 102015223062 | 2/2017 | B21D 45/10 |
| JP | H 4-293250 | 10/1992 | H01L 21/68 |
| WO | WO 2017/089049 | 6/2017 | B21D 28/06 |

OTHER PUBLICATIONS

CN Search Report in Chinese Appln. No. 201880022115.7, dated Jul. 2, 2020, 4 pages (with English translation).

German Office Action for German Application No. DE 10 2017 205 095.0 dated Feb. 28, 2018 (Machine Translation).

The International Search Report and Written Opinion for International Application No. PCT/EP2018/056884, dated Jul. 17, 2018 (in Both English and German Language).

* cited by examiner

DEVICE AND METHOD FOR REMOVING A WORKPIECE PART FROM THE REST OF THE WORKPIECE

CROSS REFERENCE TO RELATED APPLICATIONS

This application is a continuation of and claims priority under 35 U.S.C. § 120 from PCT Application No. PCT/EP2018/056884 filed on Mar. 19, 2018, which claims priority from German Application No. DE 10 2017 205 095.0, filed on Mar. 27, 2017. The entire contents of each of these priority applications are incorporated herein by reference.

TECHNICAL FIELD

The present disclosure relates to devices and methods for removing an electrically conductive workpiece part from an electrically conductive remaining workpiece.

BACKGROUND

A device for the mutual separation of two workpiece parts of a plate-like workpiece, of which one is a removed part and the other a remaining part, is described in DE 10 2014 209 811 A1. The device includes a workpiece mount that defines a mounting plane. A lift-out device is on one side of the mounting plane, while a counterholder that can be switched between a fixing state and a release state is on the opposite side of the mounting plane. To separate the two workpiece parts, the removal part, which is impinged upon on one side by the lift-out device and is supported on the other side by the counterholder, can be moved by a removal movement in a lift-out direction perpendicular to the mounting plane relative to the remaining part by the lift-out device.

The manual and automated removal of a workpiece part generated during the separating processing of workpieces (such as when stamping or (laser) cutting metal sheets) from the remaining workpiece is difficult, since the workpiece and the remaining workpiece are usually positioned in a common workpiece plane defined by a workpiece support, and are only separated from one another by a narrow separating gap. The workpiece part can therefore become misaligned with respect to the remaining workpiece as it is discharged. The possible consequences are interruptions to production, as well as damage to both the workpiece part that is to be removed and possibly to the device employed for removing the workpiece part.

For the sake of process reliability during the automated removal of a workpiece part from a remaining workpiece, a check is performed as to whether, during the preceding cutting processing by a processing tool, the workpiece part has been fully separated from the remaining workpiece, or whether the workpiece part may still be in contact with the remaining workpiece. For example, this can be because it has become misaligned with respect to the remaining workpiece or is still connected to the remaining workpiece by a thin bridge. For the sake of process reliability during automated removal, a check is also performed as to whether the workpiece part, during the movement in the removal direction and the subsequent transport for the deposition of the workpiece part to a magazine or the like, is fixed to the holding apparatus that can, for example, include one or a plurality of suction grippers.

A device for detecting the material on the surface of flat objects on a stack, for example printing plates, which can be integrated into a lifting apparatus with suction equipment for printing plates, is described in DE 102 59 190 B3. The surface is contacted with sensor electrodes for this purpose, and a measuring current passed through the surface to determine the material of which the object surface consists based on the determined current. The material surfaces that can be distinguished in this way can, for example, be paper on a printing plate or a printing plate.

A device comprising a base block with at least two supporting means for handling cover slips for microscope slides is described in DE 101 44 048 A1. A sensor that determines the presence or the state of a cover slip that has been picked up can be provided in the base block between the two supporting means. The sensor can be a capacitive sensor.

A substrate holder for a wafer in which two capacitive thin-film sensors are embedded in a trench for holding the wafer is described in JPH04-293250A. A sheet for handling a semiconductor substrate into which at least one capacitive sensor is embedded is described in U.S. Pat. No. 6,024,393.

SUMMARY

In some embodiments, a holding apparatus can be moved in a removal direction, which can be switched between a fixing state for fixing the workpiece part to the holding apparatus and a release state for releasing the workpiece part from the holding apparatus. The holding apparatus has at least one electrically conductive first contact element for contacting the workpiece part at least one first contact point (e.g., a plurality of electrically conductive first contact elements that are electrically conductively connected to one another) for contacting the workpiece part at a plurality of first contact points. The holding apparatus has at least one second electrically conductive contact element for contacting the workpiece part at least one second contact point (e.g., a plurality of electrically conductive second contact elements that are electrically conductively connected to one another) for contacting the workpiece part at a plurality of second contact points. The disclosure also relates to an associated method for removing a workpiece part from a remaining workpiece. The workpiece from which the workpiece part and the remaining workpiece are formed is typically a plate-like electrically conductive component, for example a metal sheet.

Advantages include devices and methods that improve the process reliability during the removal of a workpiece part from a remaining workpiece. Devices include a sensor apparatus that makes use of the first and second contact elements to check in a first check state the complete separation of the workpiece part from the remaining workpiece, and to check in a second check state if the workpiece part is fixed to the holding apparatus while it is in the fixing state.

The sensor apparatus enables a check in a first check state as to whether the workpiece part has been fully separated from the remaining workpiece or whether it is still in contact with the remaining workpiece. In the latter case there is an electrically conductive connection between the (electrically conductive) workpiece part and the (electrically conductive) remaining workpiece. It is possible to check using the contact elements whether or not an electrical connection exists between the workpiece part and the remaining workpiece. The check as to whether the workpiece part has been fully separated from the remaining workpiece typically takes place when the workpiece part has moved in a removal movement in the removal direction far enough out of the workpiece plane that it is located above the surface of the remaining workpiece.

The second check state of the sensor apparatus is typically used when the workpiece part has moved in a removal movement in the removal direction out of the plane of the workpiece, and the check of the separation from the remaining workpiece has taken place. To check whether the workpiece part is fixed to the holding apparatus in a position of the workpiece part at a distance in the removal direction from the remaining workpiece, it is possible to check whether the at least one first and the at least one second contact element above the workpiece part are electrically connected to one another.

In some embodiments, the sensor apparatus is configured in the first check state to determine an electrical resistance between the at least one first and/or the at least one second contact element and a reference potential. The determination of the electrical resistance is performed by known measuring methods through connection of the contact elements to a source of current or voltage and a measurement of the current or of a voltage drop. The remaining workpiece can be held at a reference potential, for example by electrically conductive clamping jaws or of a workpiece support on which the workpiece part and the remaining workpiece are lying. The reference potential can be, for example, the ground potential of the device or of the processing machine in which the device is usually integrated. In the first check state in which a check is made as to whether the workpiece part has been fully separated from the remaining workpiece, either the first electrically conductive contact element or the second electrically conductive contact element, or both together, are connected electrically conductively to the ground potential of the device for workpiece removal or to the ground potential of the processing machine into which the device for workpiece removal is integrated. If the workpiece part is still in contact with the remaining workpiece, then when a voltage is applied between the contact elements and the ground potential a closed electrical circuit is formed, and a very low electrical resistance is measured between the contact elements and the ground potential. If the workpiece part has been fully released from the remaining workpiece, the flow of current to the remaining workpiece is interrupted, so that a high resistance is determined between the contact elements and the ground potential. The device can include both a plurality of first and of second contact elements, which are respectively connected conductively together in one group. The process reliability of the measurement can be increased in this way.

The sensor apparatus can be configured in the second check state to determine an electrical resistance between at least one first contact element and at least one second contact element. To check whether the workpiece part is fixed to the holding apparatus in a position of the workpiece part at a distance in the removal direction from the remaining workpiece, in a second check state a voltage is applied by the sensor apparatus between the first and the second contact element, and an electrical resistance is determined between the contact elements. If a plurality of both first and second contact elements are in each case present, then an electrical resistance is determined between the plurality of the electrically conductively interconnected first contact elements and the plurality of the electrically conductively interconnected second contact elements. If the workpiece part is fixed to the holding apparatus, then at least one first contact element contacts the workpiece part at a first contact point, and at least one second contact element contacts the workpiece part at a second contact point, so that the first and second contact elements are electrically conductively interconnected via the workpiece part. A lower electrical resistance is accordingly measured between the first and second contact elements when the workpiece part is fixed to the holding apparatus than is the case when the workpiece part is no longer fixed to the holding apparatus. In the latter case there is no electrical contact between the first and second contact elements, and the electrical resistance becomes practically infinite.

For the checks described above at least one first contact element comes into contact with the workpiece part at one of the first contact points, and at least one second contact element does so at one of the second contact points. To perform these checks even with comparatively small workpiece parts that are to be removed, the first and second contact point(s), or the corresponding first and second contact elements, should not be with too great a spacing from one another at the holding apparatus.

In some embodiments, the holding apparatus includes a plurality of holding elements for fixing the workpiece part, where the holding elements can be switched between a fixing state for fixing the workpiece part and a release state for releasing the workpiece part. The holding elements are at a distance from one another in the holding apparatus, the arrangement typically being regular, for example in a grid arrangement.

In some embodiments, the holding elements are suction grippers and the fixing state is achieved through applying a vacuum or through a negative pressure through which the workpiece part is held at the suction gripper. In the case of suction grippers with passive flow valves, the recognition of whether the workpiece part is fixed at the suction gripper by the vacuum or by a vacuum generator is not possible, since in such suction grippers the flow valves also close in the event that the workpiece part is not fixed at the suction gripper.

In some embodiments, the at least one first contact element and/or the at least one second contact element are at the holding elements. Individual or all holding elements (for example the suction gripper) is an electrically conductive material at least on one side that is brought into contact with the workpiece part or with the remaining workpiece. In this case, for example, folded suction collars of the suction gripper that are used for contacting the workpiece part or the remaining workpiece can be an electrically conductive plastic. The first or second contact points in this case are coincident with the fixing points of the holding elements. In this case, however, the problem arises that the two checks described further above are not possible in the case of workpieces or metal sheets covered with foil or rust, since the foil or rust layer applied to the surface is not usually electrically conductive.

In some embodiments, the first contact element(s) and/or the second contact element(s) are located between the holding elements. Like the holding elements, the first or the second contact elements can also be at the holding apparatus in a regular arrangement or in a grid. Since holding elements in the form of suction grippers usually have an essentially circular geometry at least at the inlet side at which the fixing or the suction takes place, there is enough space as a rule between the suction grippers to arrange contact elements between the suction grippers.

In some embodiments, first contact elements alternate with second contact elements in at least one direction perpendicular to the removal direction. The holding apparatus or the holding elements are typically integrated into an essentially flat housing that extends in a plane perpendicular to the removal direction. The first and second contact elements alternate in at least one direction in this plane. If the holding elements are in a grid, a holding element can be in one or both directions of the grid between each first contact element and each second contact element. The contact elements do not necessarily have to alternate in more than one direction to carry out the checks described further above. The distance between the first and second contact elements or between the first and second contact points should not, however, be chosen to be too large, so that the checks described further above can also be carried out with small workpiece parts.

In embodiments, the first contact elements and/or the second contact elements include resilient contact pins for contacting the workpiece part or the remaining workpiece. DE 10 2014 209 811 A1 describes a holding apparatus that includes a rigid structure (e.g., a support surface) in which holes for receiving the holding elements (e.g., suction grippers) are made. The contact pins of the first or of the second contact elements are typically positioned with their free ends above the flat support surface and are pushed in when the workpiece part or the remaining workpiece is pushed against the flat support surface, and electrical contact is established. If resilient contact pins are used, then this makes it possible, with suitable dimensioning, in the case of sheets covered with foil or rust, for the foil or the layer of rust to be lightly scratched and an electrical contact to be established with the sheet lying underneath.

In some embodiments, the first contact elements and the second contact elements are each electrically conductively connected together through conductive tracks of the same circuit board. The conductive tracks that electrically conductively connect the first contact elements together, and the conductive tracks that electrically conductively connect the second contact elements together are not electrically conductively in contact with one another. In this case the contact elements are fastened to the circuit board, and can be with a comparatively small distance from one another.

In some embodiments, the first contact element(s) are attached or fastened to a first electrically conductive component, and the second contact element(s) are attached or fastened to a second electrically conductive component displaced in the removal direction with respect to the first. The first and second electrically conductive components are electrically insulated from one another. The two components can, for example, be electrically conductive perforated plates into which the contact element or elements are screwed. In this case, second contact elements that are fastened to the second perforated plate can be passed via an electrically insulating spacer through the first perforated plate.

In some embodiments, the device includes at least one lift-out device that is movable in the removal direction for removing the workpiece part from the remaining workpiece, where the workpiece part is held during at least part of the removal between the at least one lift-out device and the holding apparatus. The lift-out device engages the workpiece part on the side opposite to the holding apparatus, and is used to hold or support the workpiece part. The holding apparatus acts as a counterholder, and makes it possible for the workpiece part to be held perpendicularly to the workpiece plane during the movement in the removal direction between the lift-out device and in the holding apparatus, so that it does not catch on the remaining workpiece during the removal. The lift-out device(s) can, for example, be lift-out pins that can be actuated in a controlled manner independently of one another. The lift-out devices are actuated in such a way that the workpiece part is oriented parallel to the workpiece plane during the movement in the removal direction.

In some embodiments, a processing machine for the separating machining of plate-like, electrically conductive workpieces (metal sheets) by a machining tool, for example a laser cutting apparatus or a punching tool, further includes a device as described above for removing a workpiece part that is separated from the remaining workpiece during separating machining. A workpiece support that acts to support the workpiece during the separating machining can also form a workpiece support of the device for the removal of workpiece parts from the remaining workpiece. A workpiece transfer apparatus can be in the processing machine, by which the remaining workpiece can be moved together with the separated workpiece part from a machining position of the processing machine for separating machining of the workpiece to a discharge position of the apparatus for removal of the workpiece part.

In some embodiments, a method for the removal of a workpiece part from the remaining workpiece by a device as is described above includes contacting the workpiece part at at least one first contact point by at least one first contact element, as well as contacting the workpiece part at at least one second contact point by at least one second contact element, where the first and second contact elements are formed at a holding apparatus and are connected to a sensor apparatus, moving the workpiece part in a removal direction, switching the holding apparatus into a fixing state for fixing the workpiece part to the holding apparatus, checking the complete separation of the workpiece part from the remaining workpiece in a first check state of the sensor apparatus and checking the fixing of the workpiece part to the holding apparatus in a second check state of the sensor apparatus.

It is irrelevant whether the movement of the workpiece part in the removal direction takes place first followed by the switching of the holding apparatus into the fixing state, or vice versa. The movement of the workpiece part in the removal direction can take place by the holding apparatus, by a lift-out device or by a combination of holding and lift-out devices. The sequence in which the full separation of the workpiece part from the remaining workpiece and the fixing of the workpiece part to the holding apparatus is checked is also irrelevant. Both checks can also be carried out a plurality of times in an alternating sequence.

In some embodiments, in the first check state an electrical voltage is applied between the at least one first and/or the at least one second contact element and a reference potential, and an electrical resistance between the at least one first and/or the at least one second contact element and the reference potential is determined. In the second check state, an electrical resistance between the first contact element and the second contact element is measured. In place of a single contact element, a plurality of first or second contact elements connected conductively together can alternatively be used.

As described above, it is possible to establish by a resistance measurement between the first and/or second contact elements and a reference potential (typically the ground potential) whether the workpiece part has or has not been completely separated from the remaining workpiece.

The fixing of the workpiece part to the holding apparatus can take place before or after the movement of the workpiece part in the removal direction. When the workpiece part is moved in the removal direction, for example with the aid of one or a plurality of lift-out devices, a fixing of the workpiece part to the holding apparatus only takes place after the removal movement. If the holding apparatus also serves for moving the workpiece in the removal direction, then the fixing of the workpiece takes place before the removal movement, and the fixed workpiece is lifted by the holding apparatus. To check the fixing, a voltage is applied in the second check state between the first and the second contact element, or between a first and a second plurality of contact elements. In the event that at least one of the first contact elements and at least one of the second contact elements contact the workpiece part, then a lower resistance will be measured in the resistance measurement in the second check state than would be in the case that the first and second contact elements are not electrically in contact with one another via the workpiece part, so that on the basis of the resistance measurement it is possible to check whether the workpiece part is fixed to the holding apparatus.

Further advantages of the disclosure emerge from the description and the drawing. Similarly, the features listed above and those explained further can each be used alone or as a plurality in any combinations. The embodiments shown and described are not to be understood as a final list, but rather have an exemplary character for the portrayal of the disclosure.

DETAILED DESCRIPTION

Figure 1:
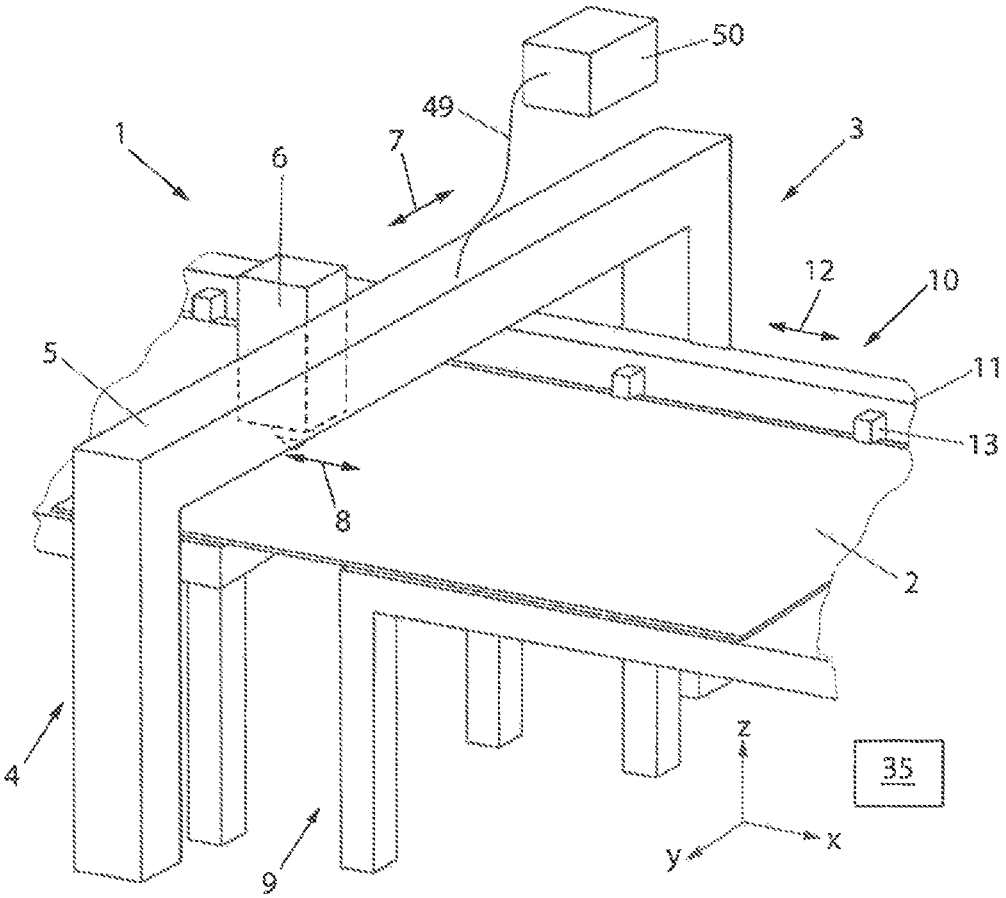
FIG. 1 shows a schematic illustration of an example of a processing machine for the separating machining of a workpiece by a laser beam.

FIG. 1 shows a processing machine 1 for the separating machining of a workpiece or a metal sheet 2 that includes a laser cutting apparatus 3 as a machining tool. The laser cutting apparatus 3 includes a guide structure 4 with a crossbeam 5 and a laser cutting head 6 carried on the crossbeam 5. The laser cutting head 6 can be moved relative to the crossbeam 5 in the directions of double arrows 7, 8, in directions perpendicular to one another. The laser cutting head 6 is connected via an optical fiber 49 to a laser beam source 50 such as a conventional solid-state laser.

The guide structure 4 reaches over a two-piece workpiece table 9 on which a metal sheet 2 rests before, during and after the cutting machining. The metal sheet 2 is processed by cutting by the laser cutting head 6 of the processing machine 1. The metal sheet 2 rests on the workpiece table 9 at the time. Dross, dust, and smoke formed during the machining are sucked away by a purging device (e.g., a suction box, not illustrated) connected to a fan and located underneath the machining region between the two parts of the workpiece table 9. After the metal sheet has been processed, workpiece parts that have been cut free by the laser cutting head 6 are separated from a remaining workpiece that is also generated by machining the metal plate (e.g., the remaining grid), and are then carried away out of the immediate vicinity of the processing machine 1.

A metal sheet movement unit 10, illustrated in a highly schematic form in FIG. 1, serves for moving the metal sheet 2 before, during, and after its machining. The metal sheet movement unit 10 includes a rail 11 that is guided movably by a guide apparatus (not illustrated) in the direction of the double arrow 12, and to which a metal sheet 2 can be fixed by clamping jaws 13.

The metal sheet 2 is positioned by the metal sheet movement unit 10 for being processed in the working region of the laser cutting head 6. The metal sheet 2 can be moved in the direction of the double arrow 12 by the metal sheet movement unit 10 during the machining. Additional movements transverse to the direction of the double arrow 12 are carried out by the laser cutting head 6 in the direction of the double arrow 7. The laser cutting head 6 moreover has an additional axis that permits short, highly dynamic movements of the laser cutting head 6 in the direction of the double arrow 8, and thus in the direction of movement of the metal sheet movement unit 10.

With a subsequent separating cut, the laser cutting head 6 cuts a workpiece part 14 (shown in FIG. 2) free from the remaining grid 15 (shown in FIG. 2), which surrounds the workpiece part that has now been cut free. The workpiece part and the remaining grid are here each located in a processing position at the processing machine 1. After finishing the machining of the metal sheet 2, the metal sheet movement unit 10 transfers the workpiece part that has been cut free and the remaining grid together out of the respective machining position into a discharge position.

Figure 2:
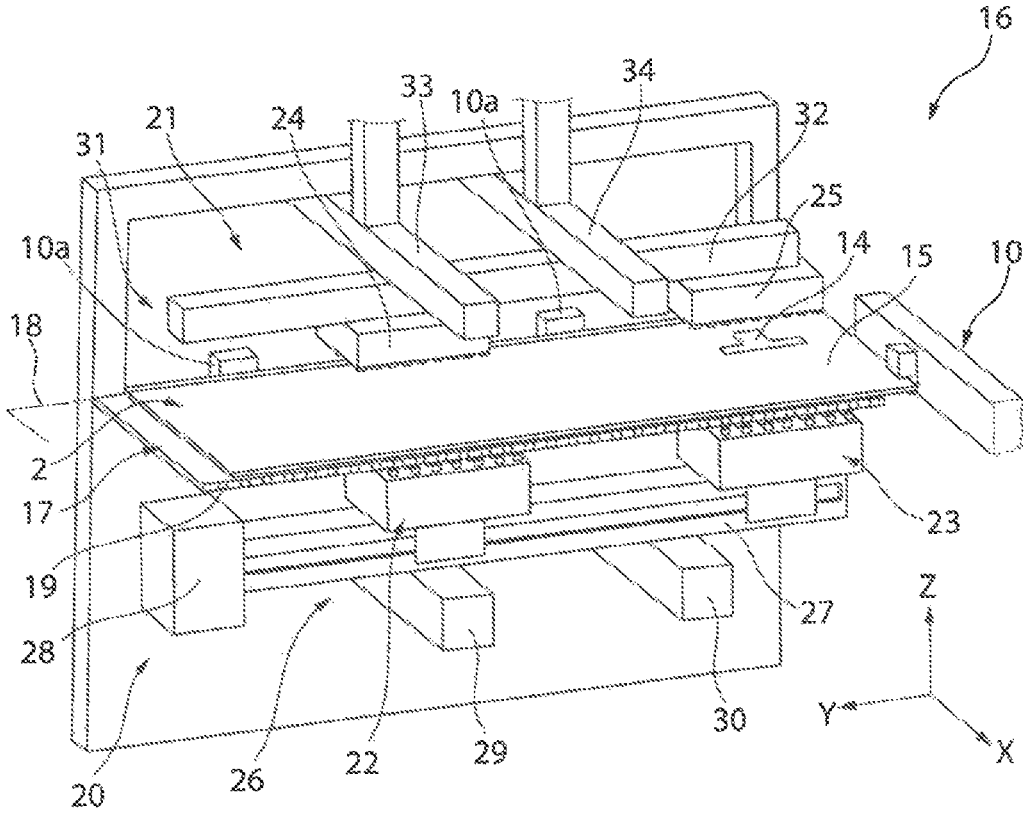
FIG. 2 shows an illustration of a device for the removal of a workpiece part from a remaining workpiece at the processing machine of FIG. 1.

The relationships illustrated in FIG. 2 result when the workpiece part 14 that has been cut free and the remaining workpiece 15 are transferred into their discharge positions. FIG. 2 shows a device 16 for removing the workpiece part 14 out of the remaining workpiece 15. For the sake of clarity, FIG. 2 only shows a single workpiece part 14 at the machined metal sheet 2 that is surrounded by the remaining workpiece 15 (remaining grid). The workpiece part 14 is removed from the remaining workpiece 15 by the device 16 before the workpiece part 14 can be transported away from the immediate vicinity of the processing machine 1. The remaining workpiece 15 here remains on the workpiece table 9 (shown in FIG. 1) before it is also taken away from the immediate vicinity of the processing machine 1 after removal of all the workpiece parts.

A plate-like workpiece support 17 of the workpiece table 9 supports the remaining workpiece 15 and the workpiece part 14. The workpiece support 17 is provided with bristles or rollers on its upper side that enable movement of the metal sheet 2 being machined over the stationary workpiece support 17 without rubbing or causing scratches, as is known in the art. The support positions of the machined metal sheet 2 on the bristles or rollers of the workpiece support 17 define a workpiece plane 18 of the workpiece support 17 shown in FIG. 2. The workpiece plane 18 runs parallel to the main plate plane of the workpiece support 17. The workpiece part 14 and the remaining workpiece 15 are flush with one another along the workpiece plane 18.

As can be seen from FIG. 2, the workpiece support 17 of the processing machine 1 is formed in the exemplary case illustrated as a perforated plate with a large number of through-holes 19. A lift-out unit 20 is underneath the workpiece support 17, and a counterholder unit 21 of the device 16 is above the workpiece support 17. The lift-out unit 20 includes two similarly constructed lift-out devices 22, 23 and the counterholder unit 21 two similarly constructed holding apparatus 24, 25.

The lift-out devices 22, 23 can be adjusted by a lift-out movement unit 26 parallel to the support plane 18 to any desired location underneath the workpiece support 17. For this purpose, the lift-out movement unit 26 includes a longitudinal rail 27, along which the lift-out devices 22, 23 can be moved by motors. A drive motor 28 of the lift-out devices 22, 23 can be seen in FIG. 2. Together with the lift-out devices 22, 23, the longitudinal rail 27 can be moved at two cross-rails 29, 30 of the lift-out movement unit 26 that are perpendicular to the longitudinal rail 27. The cross-rails 29, 30 can be raised and lowered together with the longitudinal rail 27 and the lift-out devices 22, 23 that it carries, perpendicularly to the workpiece support 17 or the workpiece plane 18.

The holding apparatus 24, 25 of the counterholder unit 21 can, in a corresponding manner, approach any desired location at the processed metal sheet 2 parallel to the support plane 18, and raised and lowered perpendicularly to the support plane 18. A holding apparatus movement unit 31 includes a longitudinal rail 32 along which the counterholder 24, 25 can be positioned by motors. Together with the counterholders 24, 25, the longitudinal rail 32 is movable by motors along a pair of cross-rails 33, 34 which for their part run perpendicular to the longitudinal rail 32 and can be raised and lowered in a vertical direction together with the longitudinal rail 32 and the holding apparatus 24, 25 that are guided on it.

All the primary functions of the processing machine 1, and thereby all the primary functions of the device 16, are numerically controlled. A numerical control unit 35 used for this purpose is illustrated in FIG. 1. The coordinate axes of the numerical control of the processing machine 1, or the device 16, are identified in FIG. 1 with x, y, z.

Figure 3A:
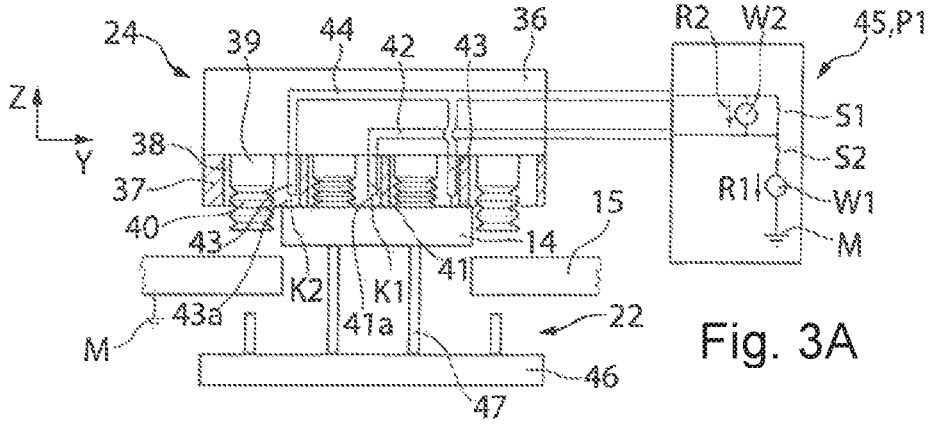
FIGS. 3A and 3B show illustrations of the removal of a workpiece part from the remaining workpiece by a holding apparatus that includes a plurality of first and second contact elements.
Figure 3B:
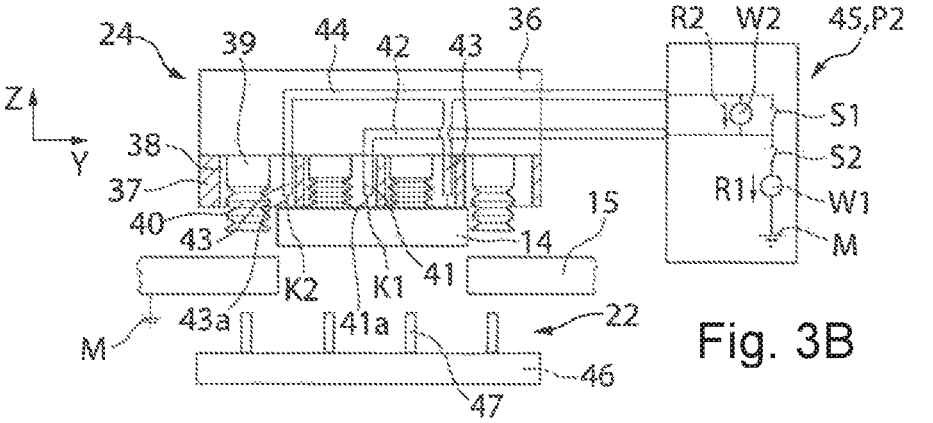

FIGS. 3A and 3B show the first holding apparatus 24 of FIG. 1 and the lift-out device 22 that acts together with it. The holding apparatus 24 includes a box-like housing 36 with a flat support plate 37 acting as a support body that has a large number of holes 38. The holes 38 accommodate holding elements in the form of suction grippers 39 that include elastically deformable suction collars 40 perpendicular to the support plate 37. In FIGS. 3A and 3B two suction collars 40 of the suction gripper 39 abut the workpiece part 14, while two of the suction grippers 39, which do not abut the remaining workpiece 15, protrude with respect to the support plate 37.

A suction chamber (not illustrated) in the interior of each individual suction collar 40 can be connected to a vacuum generator via a switchable valve. The valves are open in FIGS. 3A and 3B, meaning that there is a connection between the suction chambers of the suction grippers 39 and the vacuum generator, so that the vacuum generator can suck in air from the suction chambers. If the inlet side of the suction collar 40 of a suction gripper 39 is open and the vacuum generator is switched on, the respective valve is closed and the flow connection between the respective suction chamber and the vacuum generator that was initially present is interrupted. If the inlet side of the suction collar 40 of a suction gripper 39 is closed by the workpiece part 14 or the remaining workpiece 15, then when the vacuum generator is switched on, a vacuum is applied to the respective vacuum chamber. No significant flow of air results in the direction of the vacuum generator, so that the valve remains open and a holding force can develop at the suction gripper 39.

The first of the two lift-out devices 22, 23 has, as shown in FIG. 2, a lift-out housing 46 to which the lift-out devices 22, 23 are attached at the longitudinal rail 27 of the lift-out movement unit 26. A plurality of conventional pneumatic piston-cylinder units, each with a double-acting cylinder unit, are housed in the interior of the lift-out housing 46. A lift-out device in the form of a lift-out pin 47 is connected to each piston.

The piston-cylinder units in the interior of the lift-out housing 46 can be controlled separately, and can be connected, independently of one another, to a source of pressure. Through actuation of the piston-cylinder units, the lift-out pins 47 are extended in a vertical direction out of the lift-out housing 46 or retracted into the lift-out housing 46. The cross-section of the lift-out pins 47 corresponds to the cross-section of the through-holes 19 at the workpiece surface 17 (see FIG. 2). In the exemplary case illustrated, the cross-section of the lift-out pins 47 is smaller than the cross-section of the through-holes 19.

The removal process of the workpiece part 14 out of the remaining workpiece 15 is described below with reference to FIG. 2 and FIGS. 3A and 3B. Initially, the processed metal sheet 2 and the workpiece support 17 are positioned relative to one another in such a way that the workpiece part 14 covers a number of through-holes 19 of the workpiece support 17. The metal sheet movement unit 10 acts as a positioning device to move the processed metal sheet 2 with the workpiece part 14 and the remaining workpiece 15 in the x-direction of the coordinate system of the processing machine 1. The position that is taken up by the workpiece part 14 in the coordinate system of the numerical control of the machine arrangement 1 is defined.

The lift-out movement unit 26 underneath the workpiece support 17 is actuated under numerical control in such a way that the lift-out device 22 approaches a lift-out position underneath the workpiece part 14. Simultaneously with the positioning of the lift-out device 23, the holding apparatus 24 on the opposite side of the workpiece support 17 is moved through numerically controlled actuation of the holding apparatus movement unit 31 into a position above the workpiece part 14 that is located in the discharge position. The relationships of FIGS. 3A and 3B therefore result, where the lift-out device 22 and the holding apparatus 24 lying opposite are shown in highly schematic form. For the sake of simplicity, the workpiece support 17 is not shown in FIGS. 3A and 3B.

The vacuum generator of the holding apparatus 24 is initially switched off; the suction grippers 39 at the holding apparatus 24 are at a distance from the workpiece part 14 and also from the remaining workpiece 15 that is also in a discharge position. The suction grippers 39 are accordingly in an out-of-function state, and the holding apparatus 24 in a release state. In this functional state, the holding apparatus 24 is lowered by an appropriate vertical movement of the holding apparatus movement unit 31, and placed on the metal sheet 2, or on the workpiece part 14 and the remaining workpiece 15. The suction collars 40 of the suction grippers 39 are thus compressed and consequently more strongly folded and pushed back into the interior of the holes 38 at the support plate 37 of the holding apparatus 24, until finally the support plate 37 of the holding apparatus 24 comes to lie on the surface of the metal sheet 2.

After this, those lift-out pins 47 of the lift-out device 22 that lie underneath the workpiece part 14, and for which the workpiece part 14 is accessible through the through-holes 19 of the workpiece support 17 are actuated. The other lift-out pins 47 of the lift-out device 23 retain their initial position. With the lift-out pins 47 extended out of the lift-out housing 46, the lift-out device 22 is raised through an appropriate lifting movement of the lift-out movement unit 26 into the position of FIG. 3A. The extended lift-out pins 47 are here placed against the underneath of the workpiece part 14. The workpiece part 14 is now acted upon at its underside by the lift-out device 22 in a removal direction Z, and supported over a large area in the removal direction Z on its upper side by the holding apparatus 24, or, more precisely, by the support plate 37. The suction grippers 39 of the holding apparatus 24 that are still in the out-of-function state, abut the upper side of the workpiece part 14 that is aligned parallel to the workpiece plane 18, with an initial tension resulting from their elastic deformation.

A control signal has the effect that the lift-out device 22 and the holding apparatus 24 are moved synchronously by the lift-out movement unit 26 and the holding apparatus movement unit 31 with a removal movement in the removal direction Z. The finished part 14, which was initially in the plane of the remaining workpiece 15, is lifted here out of the remaining workpiece 15 (FIG. 3A).

A value for the magnitude of the lifting movement is determined, for example by a displacement measuring system of the numerical control of the device 16. On this basis it is ensured that the suction grippers 39 next to the workpiece part 14 and protruding beyond the support plate 37 of the holding apparatus 24 also have a significant clearance from the surface of the remaining workpiece 15 remaining on the workpiece support 17. The vacuum generator of the holding apparatus 24 is switched on. As a result of this, those suction grippers 39 that abut the workpiece part 14 are switched from the out-of-function state into a functioning state. The holding apparatus 24 is thus transferred out of the release state into the fixing state in which the workpiece part 14 is held or fixed to the holding apparatus 24.

If the workpiece part 14 is fixed to the holding apparatus 24, the lift-out pins 47 that previously impinged upon the workpiece part 14 are withdrawn into the lift-out housing 46 of the lift-out device 23. The lift-out device 23 is lowered through an appropriate lowering movement of the lift-out movement unit 26 into the position of FIG. 3B. The holding apparatus 24 thereupon moves with the workpiece part 14 fixed to it with the aid of the counterholder movement unit 31 out of the immediate vicinity of the workpiece support 17. To release the workpiece part 14 from the holding apparatus 24 at a deposition site for the workpiece part 14, the pressure is switched off from the suction grippers 39 that hold the workpiece part 14.

As can be seen in FIG. 3A, the holding apparatus 24 includes a first electrically conductive contact element 41 that is fastened to a first electrically conductive component in the form of a first electrically conductive perforated plate 42 (screwed together). The holding apparatus 24 moreover includes a plurality of second electrically conductive contact elements 43 that are fastened to a second electrically conductive component in the form of the second perforated plate 44. The second contact elements 43 are passed with electrical insulation through holes in the first perforated plate 42 with the aid of spacers. The first perforated plate 42 and the second perforated plate 44 are at a distance from one another, and insulated from one another electrically.

Connecting contacts of the two perforated plates 42, 44 are detected by a sensor apparatus 45. A first resistance measuring device W1 and a second resistance measuring device W2 are in the sensor apparatus 45. The first resistance measuring device W1 is used in a first check state P1 of the sensor apparatus 45 to determine a resistance R1 between the first and second contact elements 41, 43 and a reference potential, which in the illustrated example is the ground potential M of the device 16, or of the processing machine 1. The second resistance measuring device W2 serves to determine a resistance R2 between the first contact elements 41 and the second contact elements 43 in a second check state P2 of the sensor apparatus 45. A first switch S1 is connected in parallel with the second resistance measuring device W2, and a second switch S2 is connected in series with the first resistance measuring device W1 and the first or second contact elements 41, 43.

The first contact element 41 and the second contact elements 43 include resilient contact pins 41*a*, 43*a* that abut each a first contact point K1 or second contact points K2 at the workpiece part 14 with their free ends.

The sensor apparatus 45 makes it possible to check whether the workpiece part 14 has been fully separated from the remaining workpiece 15, or whether an electrically conductive connection still exists between the workpiece part 14 and the remaining workpiece 15. For this purpose the sensor apparatus 45 is operated in a first check state P1 illustrated in FIG. 3A, in which the first switch S1 is closed, so that the first contact element 41 and the second contact elements 43 are electrically conductively connected together. In the first check state P1, the second switch S2 is also closed, so that the electrical resistance R1 between the first and second contact elements 41, 43 and the reference potential M can be measured by the first resistance measuring device W1. In the example illustrated, the reference potential M corresponds to the potential of the remaining workpiece 15, which is connected through the clamping jaws 13, or through the workpiece support 17, to the ground potential of the processing machine 1.

In the event that the workpiece part 14 and the remaining workpiece 15 still have contact to one another, current can flow from the workpiece part 14 through the remaining workpiece 15 to the ground potential of the processing machine 1. A very small electrical resistance R1 is measured in this case. If the workpiece part is fully separated from the remaining workpiece 15 and lifted out, a closed electrical circuit does not form, and a large resistance R1 is determined between the first and the second contact elements 41, 43 and the ground potential.

It is thus possible to recognize whether the workpiece part 14 has been fully separated from the remaining workpiece 15 on the basis of the value of the measured first resistance R1. In the case of a fault (the workpiece part 14 is still connected to the remaining workpiece 15), the lift-out process can be repeated, or a fault signal can be output. In the case in which the workpiece part 14 has been fully separated from the remaining workpiece 15, the removal of the workpiece part 14 can be continued.

The sensor apparatus 45 also makes possible a check as to whether the workpiece part 14 is in fact fixed to the holding apparatus 24 while it is in the fixing state. The sensor apparatus 45 is operated for this purpose in a second check state P2, in which the first switch S1 and the second switch S2 are open, as is illustrated in FIG. 3B. With a voltage applied between the first contact element 41 and the second contact elements 43 the second resistance measuring device W2 determines the resistance R2 between the first contact element 41 and the second contact elements 43 that are in contact at the corresponding first contact point K1 and the second contact point K2 with the workpiece part 14. If an electrical contact is established between the first and the second contact elements 41, 43 through the workpiece part 14 fixed to the holding apparatus 24, the electrical resistance R2 that is measured by the second resistance measuring device W2 is very small. If the workpiece part 14 is not fixed to the holding apparatus 24, the first contact element 41 is electrically insulated from the second contact elements 43, so that the electrical resistance R2 that is measured by the second resistance measuring device W2 is very large, or tends practically to infinity. If it is detected through the check that the workpiece part 14 is not fixed to the holding apparatus 24, a new attempt can for example be made to fix the workpiece part 14 to the holding apparatus 24. The output of a fault signal is alternatively possible.

As illustrated in FIGS. 3A and 3B, the first contact elements 41 alternate with the second contact elements 43 in the Y-direction. The first contact elements 41 and the second contact elements 43 also alternate in the X-direction so that the first contact elements 41 as well as the second contact elements 43 are in a regular arrangement in the manner of a grid.

The way in which the removal device 16 functions was described above with reference to a processing machine 1 with a combined movement of the workpiece 2 and of the laser cutting head 6. The removal device can, however, also be employed in an analogous manner at a processing machine in which the workpiece is stationary during the machining and is, for example, on a bridge support that can be moved into the processing region of the machine and out of it with the aid of a pallet changer.

If the removal device 16 is used for the automation of such a flying optics machine, this is also possible without an additional lift-out device. To remove a workpiece part from the remaining workpiece, the holding apparatus 24 is in this case first placed on the surface of the workpiece part 14, after which the vacuum generator of the holding apparatus 24 is switched on. The holding apparatus 24 is thus transferred from the release state into the fixing state in which the workpiece part 14 is held or fixed on the holding apparatus 24. To prevent the remaining workpiece 15 being fixed to the holding apparatus 24, the holding elements 39 can, for example, be implemented as active suction units whose opening state can be changed by a controller. The holding apparatus 24 can alternatively be adapted to the shape of the workpiece parts 14 to be removed in such a way that holding elements 39 are only in the region of the workpiece part 14. A support plate 37 is not necessary in this example.

Figure 4:
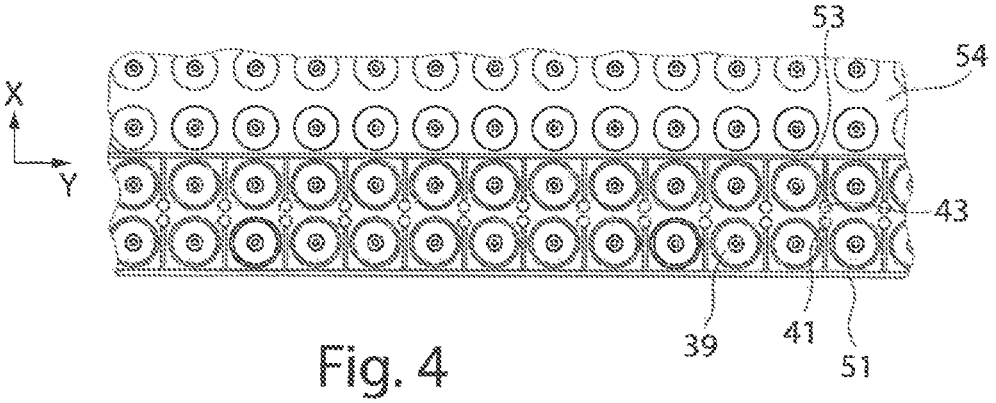
FIG. 4 shows an illustration of a circuit board to which first and second contact elements of the holding apparatus are fastened.

FIG. 4 shows a plan view of the underside of an alternative holding apparatus 24 with suction grippers 39. Alternatively to what is shown in FIGS. 3A and 3B, in FIG. 4 the first contact elements 41 and the second contact elements 43 are fastened to a common circuit board 54. The first contact elements 41 are here electrically conductively connected to one another through first conductive tracks 51, while the second contact elements 43 are electrically conductively connected to one another through second conductive tracks 53 that are electrically insulated from the first conductive tracks 51. FIG. 4 shows an example of just two rows of contact elements 41, 43. In the example shown, the first contact elements 41 only alternate with the second contact elements 43 in the X-direction, but not in the Y-direction. The fastening of the first and second contact elements 41, 43 to a common circuit board 54 makes it possible to position the first and the second contact elements 41, 43 with a smaller spacing from one another than is the case in the example shown in FIGS. 3A and 3B.

As an alternative to the example shown in FIGS. 3A and 3B and in FIG. 4, the suction grippers 39 can themselves be (first or second) contact elements. In this case, the suction collars 40 are typically manufactured from an electrically conductive material, e.g., from an electrically conductive plastic. The suction grippers 39 can in this case be divided into two groups that are electrically conductively connected to one another to form the first and second contact elements 41, 43. Only the first contact elements 41 can be located at the suction grippers 39 while the second contact elements 43 are between the suction grippers 39, or vice versa. The tips of the resilient contact pins 41*a*, 43*a*, in the case of a foil-covered metal sheet 2, can lightly scratch the surface of the foil applied to the metal plate 2, so that an electrical contact is established. This is unlikely if the suction grippers 39 with plastic suction collars 40 are used as contact elements.

Other Embodiments

A number of embodiments of the invention have been described. Nevertheless, it will be understood that various modifications may be made without departing from the spirit and scope of the invention. Accordingly, other embodiments are within the scope of the following claims.

What is claimed is:

1. A device for removing an electrically conductive workpiece part from an electrically conductive remaining workpiece, the device comprising:

a holding apparatus that is moveable in a removal direction and configured to be switched between a fixing state for fixing the workpiece part to the holding apparatus and a release state for releasing the workpiece part from the holding apparatus, wherein the holding apparatus comprises:

at least one first electrically conductive contact element for contacting the workpiece part at one or more first contact points, and at least one second electrically conductive contact element for contacting the workpiece part at one or more second contact points; and a sensor apparatus in communication with the at least one first and the at least one second contact element and configured, in a first check state, to determine if there is complete separation of the workpiece part from the remaining workpiece and to determine an electrical resistance between one or both of the at least one first contact element and the at least one second contact element, and a reference potential, and to determine, in a second check state, if the workpiece part is fixed to the holding apparatus while the holding apparatus is in the fixing state.

2. The device of claim 1, wherein the sensor apparatus is configured to, in the second check state, determine an electrical resistance between the at least one first contact element and the at least one second contact element.

3. The device of claim 1, wherein the holding apparatus comprises a plurality of holding elements for fixing the workpiece part, the holding elements being configured to be switched between a fixing state for fixing the workpiece part and a release state for releasing the workpiece part.

4. The device of claim 3, wherein the holding elements are suction grippers.

5. The device of claim 1, wherein one or both of the at least one first contact element and the at least one second contact element are located at a holding element.

6. The device of claim 5, wherein one or both of the at least one first contact element and the at least one second contact element are located between the holding elements.

7. The device of claim 1, wherein the at least one first contact element alternates with the at least one second contact element in at least one direction perpendicular to the removal direction.

8. The device of claim 1, wherein one or both of the at least one first contact element and the at least one second contact element comprise resilient contact pins for contacting the workpiece part or the remaining workpiece.

9. The device of claim 1, wherein the holding apparatus comprises a plurality of first contact elements and a plurality of second contact elements that are respectively connected to one another by conductive tracks of a same circuit board.

10. The device of claim 1, further comprising at least one lift-out device that is movable in the removal direction for removing the workpiece part from the remaining workpiece, wherein the workpiece part is held during at least part of the removal between the at least one lift-out device and the holding apparatus.

11. A processing machine for the separating machining of plate-like, electrically conductive workpieces by a machining tool, comprising:

a laser beam source that emits a laser beam;

a device for removing a workpiece part that is separated from a remaining workpiece during separating machining with the laser beam, the device comprising:

a holding apparatus that is moveable in a removal direction and configured to be switched between a fixing state for fixing the workpiece part to the holding apparatus and a release state for releasing the workpiece part from the holding apparatus, wherein the holding apparatus comprises:

at least one first electrically conductive contact element for contacting the workpiece part at one or more first contact points, and at least one second electrically conductive contact element for contacting the workpiece part at one or more second contact points; and a sensor apparatus in communication with the at least one first and the at least one second contact element and configured, in a first check state, to determine if there is complete separation of the workpiece part from the remaining workpiece and to determine an electrical resistance between one or both of the at least one first contact element and the at least one second contact element, and a reference potential, and to determine, in a second check state, if the workpiece part is fixed to the holding apparatus while the holding apparatus is in the fixing state.

12. A method for removal of a workpiece part from a remaining workpiece using a device, the method comprising:

contacting the workpiece part at one or more first contact points with one or more first contact elements as well as contacting the workpiece part at one or more second contact points with one or more second contact elements, wherein the one or more first contact elements and the one or more second contact elements are positioned on a holding apparatus and are connected to a sensor apparatus, moving the workpiece part in a removal direction, switching the holding apparatus into a fixing state for fixing the workpiece part to the holding apparatus, and detecting if there is complete separation of the workpiece part from the remaining workpiece, detecting an electrical resistance between one or both of the one or more first contact elements and the one or more second contact elements, and detecting a reference potential in a first check state of the sensor apparatus and checking if the workpiece part is fixed to the holding apparatus in a second check state of the sensor apparatus, wherein the device comprises a holding apparatus that is moveable in a removal direction and configured to be switched between the fixing state and a release state for releasing the workpiece part from the holding apparatus.

13. The method of claim 12, wherein, in the second check state an electrical resistance is determined between the one or more first contact elements and the one or more second contact elements.

* * * * *